US006789513B2

(12) United States Patent
Ziabazmi

(10) Patent No.: US 6,789,513 B2
(45) Date of Patent: Sep. 14, 2004

(54) BAZMI'S SIX-STROKE ENGINE WITH INTAKE-EXHAUST VALVES

(76) Inventor: Alireza Ziabazmi, 8363 Van Buren Dr., Pittsburgh, PA (US) 15237

( * ) Notice: Subject to any disclaimer, the term of this patent is extended or adjusted under 35 U.S.C. 154(b) by 0 days.

(21) Appl. No.: 10/706,549

(22) Filed: Nov. 12, 2003

(65) Prior Publication Data

US 2004/0123819 A1 Jul. 1, 2004

Related U.S. Application Data

(63) Continuation-in-part of application No. 10/164,659, filed on Jun. 10, 2002, now abandoned.

(51) Int. Cl.[7] ..... F02B 75/02
(52) U.S. Cl. ..... 123/64; 123/79 R
(58) Field of Search ..... 123/64, 79 R, 123/188.2, 188.4

(56) References Cited

U.S. PATENT DOCUMENTS 1,695,704 A * 12/1928 Archer ..... 123/64
1,766,401 A * 6/1930 Plato ..... 123/64
1,992,721 A * 2/1935 Smith ..... 123/79 R
2,420,136 A * 5/1947 Hill ..... 123/64

* cited by examiner

*Primary Examiner*—Noah P. Kamen

(57) ABSTRACT

The present invention relates to a six-stroke internal combustion engine with intake-exhaust valves. All valves in the combustion chamber are named intake-exhaust valves, because said valves function as both intake valves in an intake stroke and exhaust valves in an exhaust stroke. Because in said engine each cycle comprises an intake stroke, a compression stroke, a power stroke, an exhaust stroke, the fifth stroke and the sixth stroke, there is an interval between the exhaust stroke and the intake stroke of the next cycle. Said interval includes strokes five and six. During the exhaust stroke and said interval, all exhaust gases are expelled from a cylinder and cylinder head completely before the intake stroke of the next cycle begins. Utilizing every valve in the combustion chamber as an intake and exhaust valve increases the volumetric efficiency of the engine.

8 Claims, 8 Drawing Sheets

BAZMI'S SIX-STROKE ENGINE WITH INTAKE-EXHAUST VALVES

CROSS-REFERENCE TO RELATED APPLICATIONS

The present application is a Continuation-In-Part application of U.S. patent application Ser. No. 10/164,659, entitled BAZMI'S SIX STROKE ENGINE, filed on Jun. 10, 2002 now abandoned.

This application is also based on and incorporates herein by reference U.S. Pat. No. 1,259,728, entitled "Engine Valve Mechanism," filed on Mar. 12, 1917, and U.S. Pat. No. 1,992,721, entitled "Valve Mechanism for Internal Combustion Engine," filed on Feb. 3, 1933, and U.S. Pat. No. 2,420,136, entitled "Six Cycle Engine," filed on Oct. 11, 1944.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND OF THE INVENTION

1. Field of the Invention

The present invention relates to a six-stroke internal combustion engine in which all valves in the combustion chamber function as both intake valves in an intake stroke and exhaust valves in an exhaust stroke.

2. Description of the Related Art

Valves functioning as both intake and exhaust valves are conventionally known from U.S. Pat. No. 1,259,728. A valve or valves in a combustion chamber open in an exhaust stroke and remain open in the intake stroke of the next cycle. Therefore, each valve operates as both intake valve and exhaust valve in order to improve engine efficiency.

One of the problems with the above systems is that, because there is no interval between an exhaust stroke and the intake stroke of the next cycle, some of the exhaust gases are drawn into the cylinder in the next intake stroke. This reduces the engine efficiency. There are also moving parts such as sleeve valves in the cylinder head that increase friction and require extra lubrication. Moreover, inlet ports and outlet ports were designed in a manner that, even if there was an interval between an exhaust stroke and the intake stroke of the next cycle, some of the gases of the exhaust stroke would be drawn into the cylinder in the intake stroke of the next cycle.

Various types of six-stroke reciprocating piston internal combustion engines have been heretofore designed and some examples of which are disclosed in U.S. Pat. No. 2,420,136, U.S. Pat. No. 4,289,097, U.S. Pat. No. 4,924,823, FR Patent No. 2,547,625, CN Patent No. 1,412,422, and JP Patent No. 2,119,635.

There are various modes of cycling the intake charge and exhaust gases during the operation of the six-stroke engines to improve energy efficiency. But a six-stroke internal combustion engine with intake-exhaust valves utilizing stroke five and stroke six as an interval between an exhaust stroke and the intake stroke of the next cycle is not known.

SUMMARY OF THE INVENTION

In order to increase volumetric efficiency, the area of intake and exhaust valves and ports must be increased so that more air or fuel-air mixture is introduced into a cylinder in an intake stroke, and more exhaust gases are expelled from the cylinder in an exhaust stroke. That is why internal combustion engines with three, four or five valves per cylinder are manufactured. It is to be noted that more than five valves in the combustion chamber of a cylinder will lead to mechanical complexities which make them practically impossible.

The main object of the present invention is to increase the area of intake and exhaust valves and ports in order to generate a large power and torque and to improve engine efficiency. In this invention, all of the valves in the combustion chamber function as both intake valves and exhaust valves; in other words, air or fuel-air mixture goes into a cylinder via all of the combustion chamber valves in an intake stroke and in an exhaust stroke, the exhaust gases are expelled from the cylinder via the same valves. The inlet ports and outlet ports are connected to each other in the cylinder head. Therefore, in this engine the area of the intake and exhaust valves and ports increases by two times in comparison with the area of the intake and exhaust valves and ports in a traditional engine with the same number of valves in the combustion chamber. It should be noted that the name of said combustion chamber valves is intake-exhaust valves or inlet-outlet valves.

Special exhaust valves are mounted in the side of the cylinder head, outside the combustion chamber in the outlet ports. Said exhaust valves are closed in the intake stroke and are open in the exhaust stroke. As a result, exhaust gases are expelled from the cylinder and cylinder head via the outlet ports, and said exhaust gases do not go into the inlet ports in the exhaust stroke. Also, in the intake stroke, exhaust gases of the previous exhaust stroke are not drawn into the cylinder.

There is a need for an interval at the end of the exhaust stroke during which exhaust gases are expelled from the cylinder head completely. There is also a need for a mechanism to close the combustion chamber valves (intake-exhaust valves) at the end of the exhaust stroke and open them at the beginning of the intake stroke of the next cycle within the interval. Therefore, the fifth stroke and the sixth stroke are considered for the engine related to the invention; in other words, this engine operates on a six-stroke cycle.

Special cams are designed for the valves of the engine. The radius and circumference of said cams are fifty percent larger than the radius and circumference of the traditional ones used in a four-stroke engine in order to cover all of the six strokes. In this case, there is no need to change the camshaft-to-crankshaft gear ratio used in a traditional four-stroke engine.

The present invention is applied to gasoline engines, diesel engines, and also multi-cylinder engines.

DETAILED DESCRIPTION OF THE INVENTION

In order to increase the volumetric efficiency of an internal combustion engine, each valve in the combustion chamber can be utilized as both an intake valve in an intake stroke and an exhaust valve in an exhaust stroke. Said valve is named intake-exhaust valve. In this engine, there must be at least one valve per cylinder in the combustion chamber. Of course, it will be more efficient to use two, three, four or even five valves per cylinder in the combustion chamber. The embodiment of the invention in which there are two valves in the combustion chamber is first described.

Figure 2:
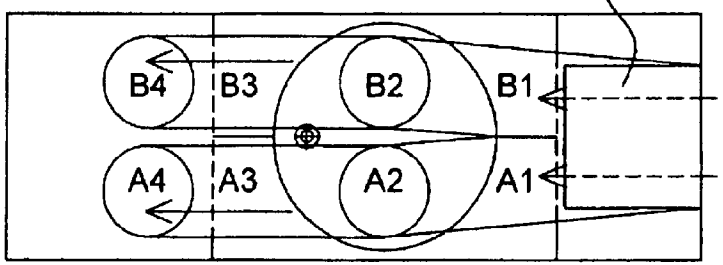
FIG. 2 is a schematic view showing the ports and valve seats of the cylinder head.
Figure 1:
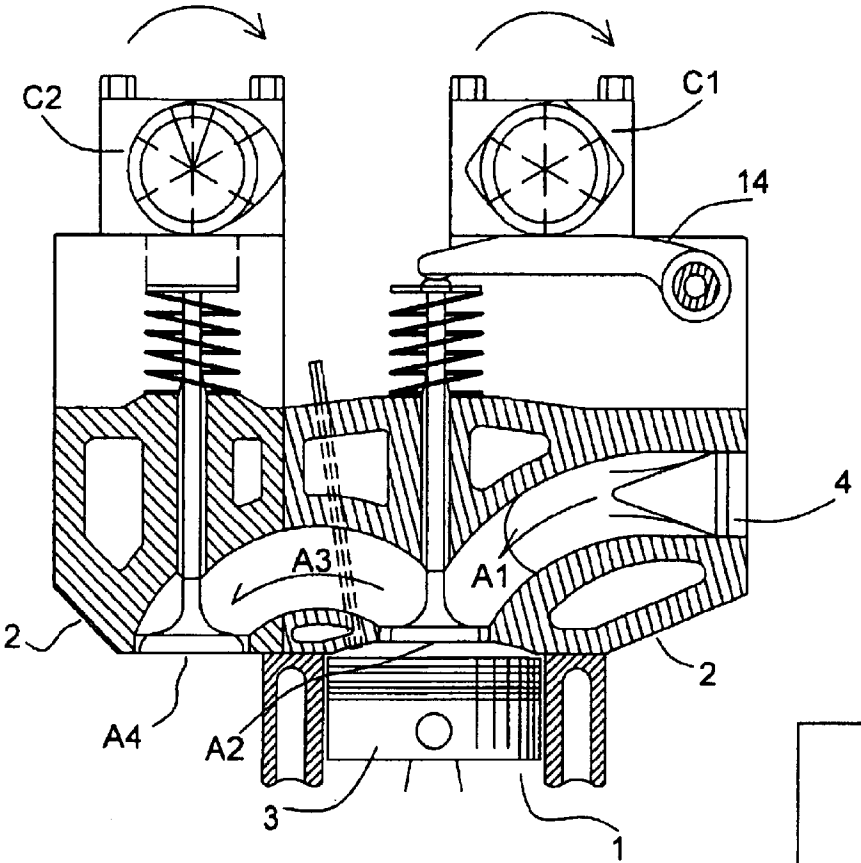
FIG. 1 is a vertical cross-sectional view of the cylinder and cylinder head related to the invention.

Referring to FIGS. 1 and 2, valves A2 and B2 are mounted in a cylinder head 2, above the combustion chamber. Said valves are intake-exhaust valves. Valves A4 and B4 are mounted in the side of the cylinder head 2, outside the combustion chamber. Valves A4 and B4 are just exhaust valves.

In an intake stroke, valves A2 and B2 are open, but valves A4 and B4 are closed. As a result, air or air-fuel mixture goes into a cylinder 1 via inlet ports A1 and B1. During the compression and combustion strokes, valves A2, B2, A4 and B4 are closed. In an exhaust stroke, intake-exhaust valves A2 and B2 and exhaust valves A4 and B4 are open so that exhaust gases are expelled from the cylinder 1 and cylinder head 2 via outlet ports A3 and B3.

In the fifth stroke, a piston 3 goes down from top dead center to bottom dead center. In the sixth stroke, said piston goes up from bottom dead center to top dead center. The fifth stroke and the sixth stroke provide an interval. During said interval, and especially within the first half of the fifth stroke, exhaust gases are expelled from the cylinder head 2 via the outlet ports A3 and B3. It was mentioned that the exhaust valves A4 and B4 are closed in the intake stroke. Therefore, exhaust gases are not drawn into the cylinder 1 in the intake stroke of the next cycle.

In order to prevent the pressure inside the cylinder 1 from reducing while the piston 3 moves downward in the second half of the fifth stroke, intake-exhaust valves A2 and B2 open in the middle of the fifth stroke. Said valves close approximately at the beginning of the sixth stroke. In addition to that, air is drawn into the cylinder 1 within the second half of the fifth stroke before the start of the next cycle. This also increases the engine efficiency.

Exhaust gases do not go into the inlet ports A1 and B1 in the exhaust stroke, because air is coming into said inlet ports due to the suction of the previous intake strokes. In order to make the engine start and work more smoothly and more efficiently, Reed valves 4 can be mounted in the inlet ports.

Figure 3:
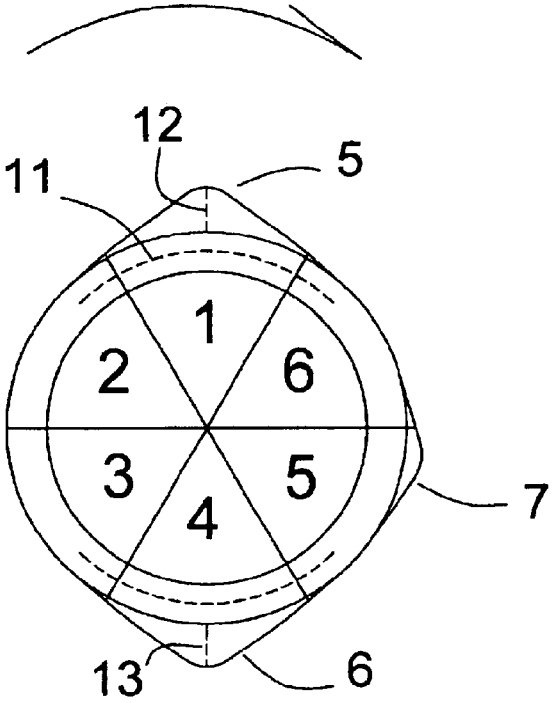
FIG. 3 is a view of a cam exclusive for intake-exhaust valves A2, B2.

Referring to FIG. 3, a cam exclusively designed for intake-exhaust valves A2 and B2 are shown. There are three cam lobes on said cam. The cam lobe 5 is designed to actuate the intake-exhaust valves A2 and B2 in an intake stroke. The cam lobe 6 is designed to open said valves in an exhaust stroke. The cam lobe 7 is designed to open said valves approximately in the middle of the fifth stroke and close them at the beginning of the sixth stroke. Said cam is marked with C1 in FIGS. 1 and 11.

Figure 4:
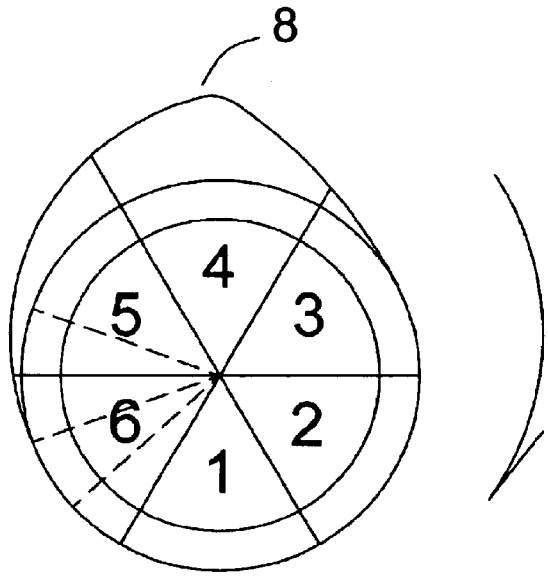
FIG. 4 is a view of a cam exclusive for exhaust valves A4 and B4.

Referring to FIG. 4, a cam exclusively designed for exhaust valves A4 and B4 are shown. There is one cam lobe on said cam. The cam lobe 8 is designed to open said valves approximately at the beginning of the exhaust stroke and close them approximately in the middle of the sixth stroke. Said cam is marked with C2 in FIGS. 1 and 11.

Figure 5:
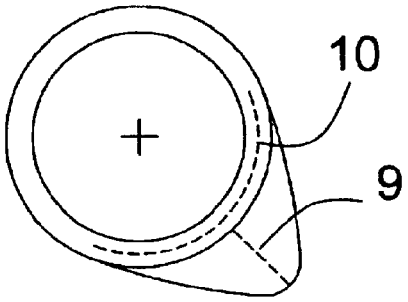
FIG. 5 is a view of a traditional cam used in a four-stroke engine.
Figure 8:
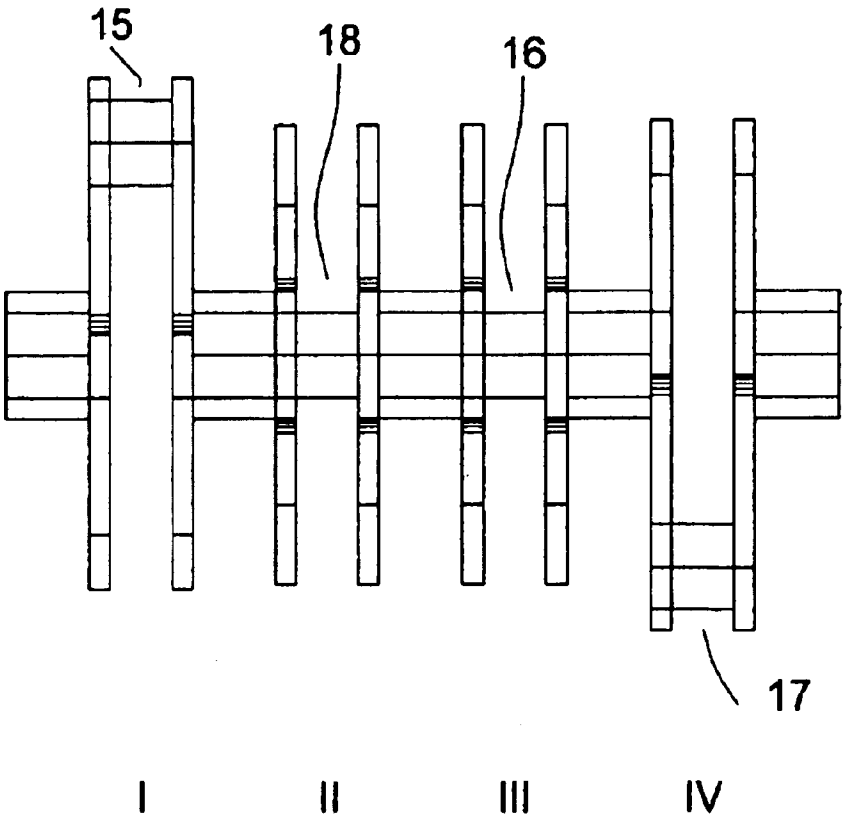
FIG. 8 is a right view of FIG. 7.

Referring to FIG. 5, a traditional cam used in a four-stroke engine is shown for a comparison. The distance that a valve is lifted (valve lift) is marked with 9. The distance that a valve stays up (valve duration) is marked with 10.

As it was aforementioned, the engine is a six-stroke type. Therefore, a working cycle does not correspond to 720 degrees but 1080 degrees of crankshaft angle. In order not to change the camshaft-to-crankshaft ratio used in a four-stroke engine, the circumference of the cams connected to the valves A2, B2, A4 and B4 are designed fifty percent larger than that of the traditional ones. Therefore, the larger cams can cover the six strokes. As a result, the valve duration of the valves A2 and B2, 11 (FIG. 3) designed for the six-stroke engine equals the valve duration of an ordinary valve 10 (FIG. 5) used in a four-stroke engine.

Figure 6:
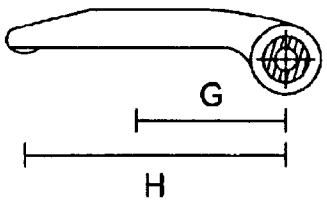
FIG. 6 shows a rocker arm for use in the present invention. The rocker arm ratio is 1.8:1 (H: G).
Figure 11:
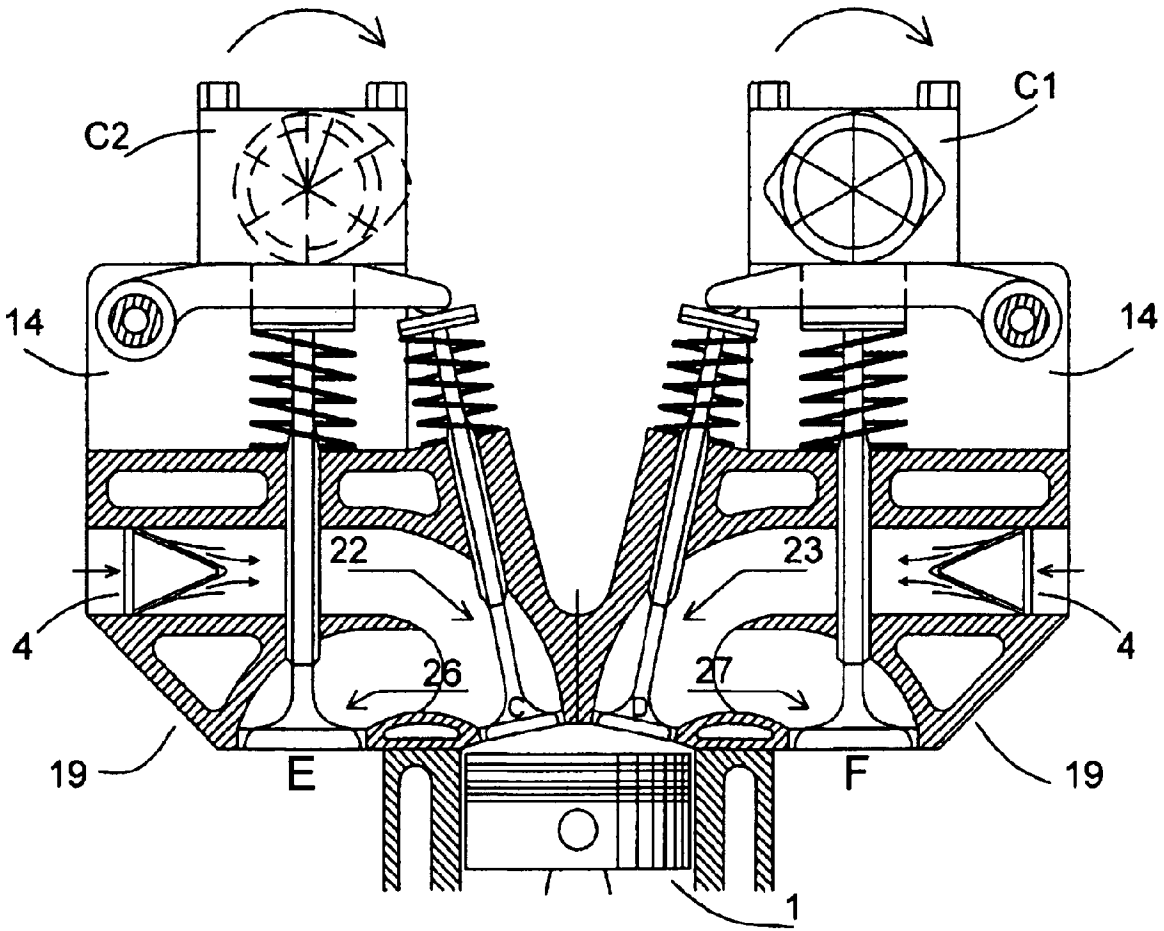
FIG. 11 is a vertical cross-sectional view of the cylinder and cylinder head related to the invention with four valves in the combustion chamber, and two exhaust valves in the cylinder head outside the combustion chamber for each cylinder.

As mentioned above, the arc length 11 (FIG. 3) equals the arc length 10 (FIG. 5), and the circumference of the cams for the valves A2 and B2 are larger than the circumference of the ordinary ones. Therefore, the valve lift 12 (FIG. 3) of the valves A2 and B2 must be reduced with respect to the valve lift of the ordinary one 9 (FIG. 5) so that the cams and rocker arms function together smoothly and efficiently. The reduction in the valve lift of the valves A2 and B2 can be compensated by special rocker arms 14 (FIGS. 1 and 11). The rocker arm ratio is 1.8 to 1 (H to G), as shown in FIG. 6.

Because of the pressure of exhaust gases, the valve lift 13 (FIG. 3) of the valves A2 and B2 in an exhaust stroke can be less than the valve lift 12 (FIG. 3) of said valves in an intake stroke in order to improve energy efficiency, as the area of the exhaust valves is smaller than that of the intake valves in a traditional engine.

Referring to FIG. 3, the cam exclusive for the intake-exhaust valves A2 and B2 can be designed in a manner that the valves A2 and B2 open earlier for the intake stroke and close later for the exhaust stroke a few degrees of crankshaft revolution. This also increases the volumetric efficiency. There will not be any problem of valve overlapping like the one in traditional engines even at low engine speeds.

Referring to FIGS. 4 and 1, the cam exclusive for the exhaust valves A4 and B4 can be designed in a manner that the valves A4 and B4 open earlier for the exhaust stroke a few degrees of crankshaft revolution. The suction of previous cycles causes a one-way flow of air entering the inlet ports A1 and B1 and exiting the cylinder head 2 via the outlet ports A3 and B3. This fast flow of air reduces the pressure in the outlet ports. Therefore, the exhaust gases flow out of the cylinder 1 and cylinder head 2 more rapidly.

Due to the suction of the previous intake strokes, air continues to enter the inlet ports A1 and B1 and to exit the cylinder head 2 via the outlet ports A3 and B3 along with the exhaust gases during the exhaust stroke and the fifth stroke. The mixing of the fresh air and the exhaust gases in the outlet ports A3 and B3 allows the complete combustion of unburnt gases. This reduces the emissions of pollutants. When the exhaust valves A4 and B4 are closed in the middle of the sixth stroke, pressure inside the cylinder head 2 increases before the intake stroke of the next cycle begins.

As it was mentioned previously, the exhaust valves A4 and B4 close approximately in the middle of the sixth stroke. Of course, the cam lobe 8 (FIG. 4) can be designed in a manner that the valves A4 and B4 close approximately at the end of the sixth stroke so that the fresh air does not stagnate inside the cylinder head 2 in the inlet ports A1 and B1 onto the backside of the intake-exhaust valves A2 and B2, especially at higher RPMs. As soon as the intake-exhaust valves A2 and B2 open at the beginning of the intake stroke, the fresh air goes into the cylinder rapidly. Therefore, more fresh air is rapidly available to the cylinders. This improves the suction of the intake stroke, especially at higher RPMs. This could also be done by utilizing a conventional variable valve timing system in order to optimize the engine efficiency according to low or high RPMs, meaning that at low RPMs valves A4 and B4 close in the middle of the sixth stroke, and at higher RPMs said valves close at the end of the sixth stroke.

Figure 7:
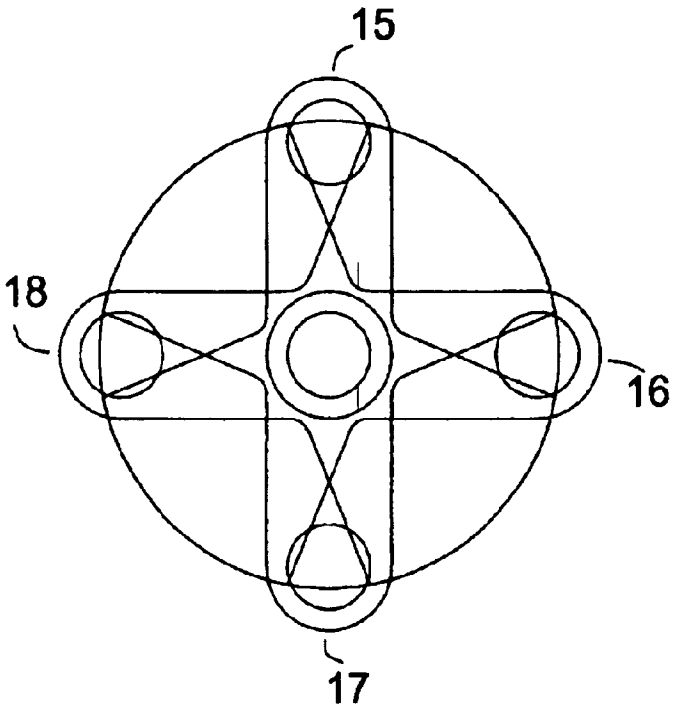
FIG. 7 is a front view of a crankshaft especially designed for a six-stroke four-cylinder engine related to the invention.
Figure 9:
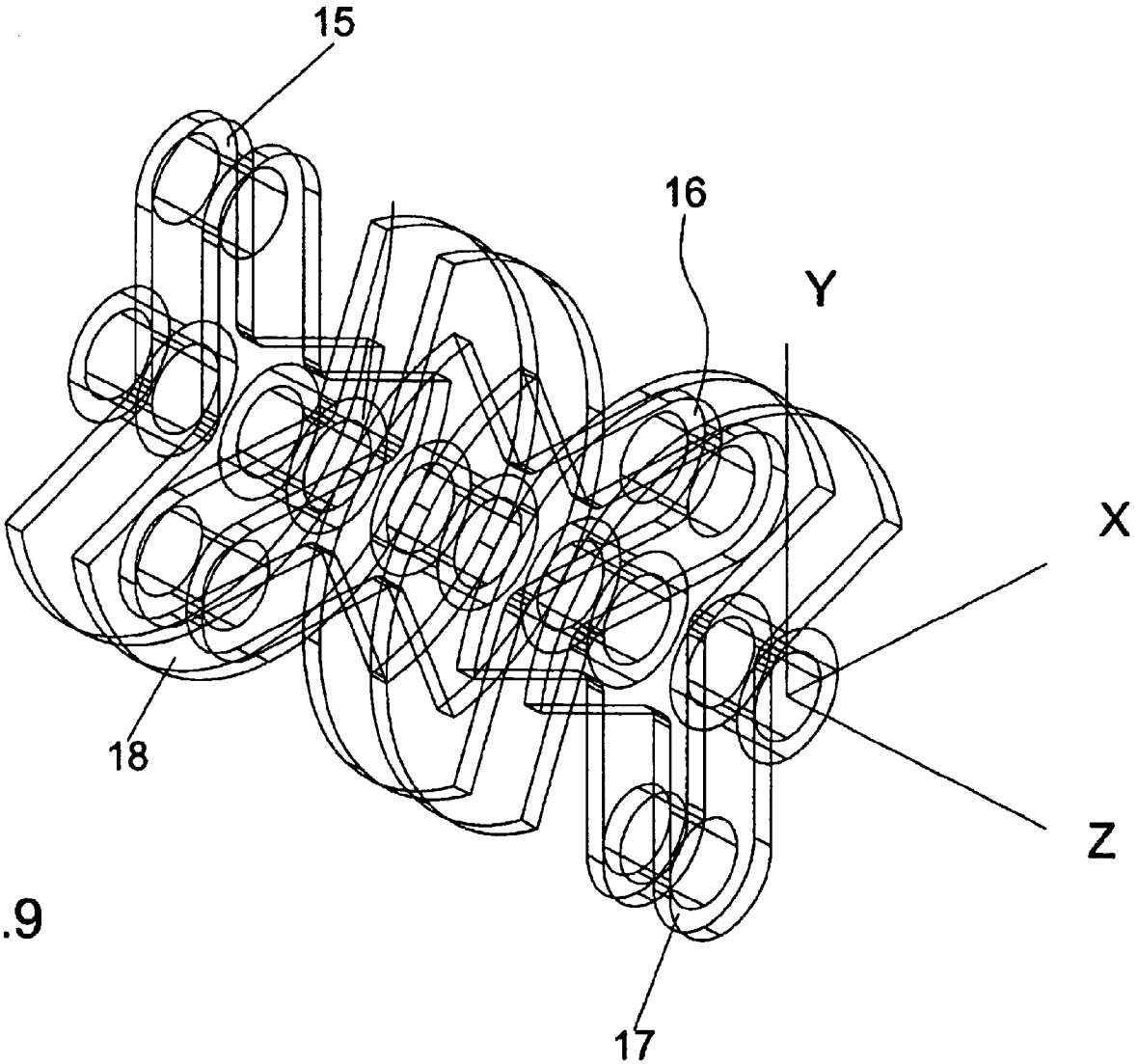
FIG. 9 is a 3D perspective view of FIG. 8.
Figure 10:
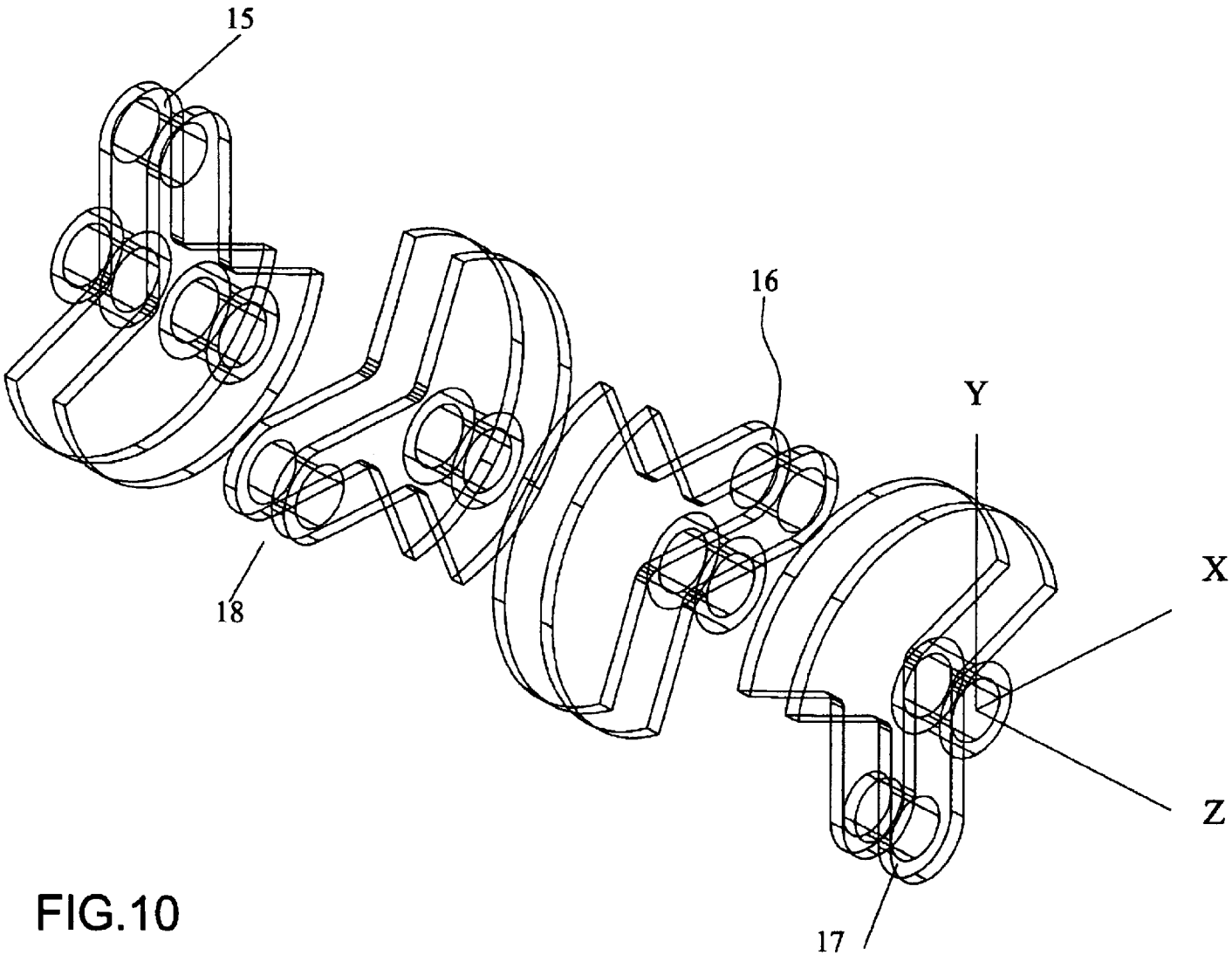
FIG. 10 is an exploded view of FIG. 9.

Because a working cycle corresponds to 1080 degrees of crankshaft angle in this engine, two pistons of the two cylinders, having subsequent firing order, are 270 degrees apart on a crankshaft in a six-stroke four-cylinder engine. FIGS. 7 through 10 show different views of a crankshaft especially designed for the six-stroke four-cylinder engine. FIG. 7 shows a symmetrical position of crankpins designed for the six-stroke four-cylinder engine. In said engine with the firing order of 1-3-4-2, crankpins 15, 16, 17, and 18 (FIG. 8) are related to cylinder I, cylinder III, cylinder IV and cylinder II, respectively. The vibration of the six-stroke four-cylinder engine utilizing said crankshaft is less than that of a four-stroke, four-cylinder engine with a traditional crankshaft.

In order to find the interval between power strokes in multi-cylinder engines, 1080 must be divided by the number of cylinders.

The second embodiment of the invention in which there are four valves per cylinder in the combustion chamber is described next.

Figure 12:
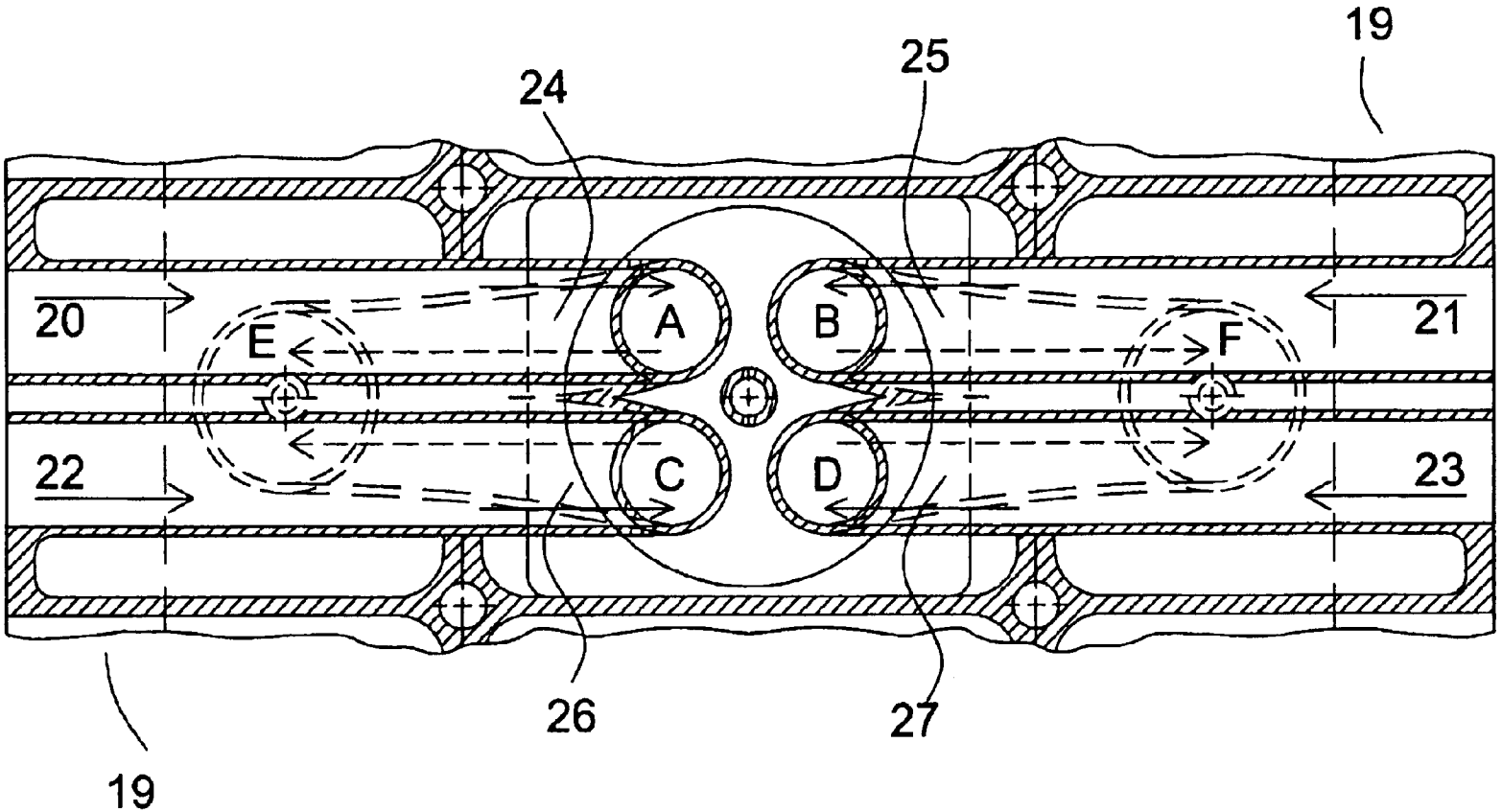
FIG. 12 is a horizontal cross-sectional view showing the ports and valve seats of the cylinder head related to FIG. 11.

Referring to FIGS. 11 and 12, there are totally six valves per cylinder. Four valves A, B, C and D are intake-exhaust valves located at the top of the combustion chamber. There are also two exhaust valves E and F in the cylinder head 19, outside the combustion chamber. Said intake-exhaust valves are actuated by four rocker arms (two of the rocker arms are visible in FIG. 11).

Inlet ports 20–23 are connected to outlet ports 24–27. In an intake stroke, intake-exhaust valves A, B, C, and D are open. Exhaust valves E and F are closed in the intake stroke. Air or air-fuel mixture goes into a cylinder 1 via the inlet ports 20–23. In the compression and combustion strokes, said intake-exhaust valves are closed. The exhaust valves E and F remain closed during the compression and combustion strokes. In an exhaust stroke, again said intake-exhaust valves are open. Also, said exhaust valves E and F are open in the exhaust stroke. As a result, exhaust gases are forced out of the cylinder 1 and cylinder head 19 via the outlet ports 24–27.

All of or some of the intake-exhaust valves A, B, C, and D open in the middle of the fifth stroke and close at the beginning or in the middle of the sixth stroke. This depends on the engine and the way that the inlet ports and outlet ports are designed. If exhaust gases are completely expelled from the cylinder head 19 within the first half of the fifth stroke, it will be more efficient to open all of said valves in the middle of the fifth stroke and to close said valves at the beginning of the sixth stroke. If exhaust gases are not completely expelled from the cylinder head 19 within the first half of the fifth stroke, it will be more efficient to open one of said valves in the middle of the fifth stroke and to close said valve in the middle of the sixth stroke. In this case, some of the exhaust gases that are drawn into the cylinder in the second half of the fifth stroke are expelled from the cylinder completely in the first half of the sixth stroke. Said exhaust gases are completely expelled from the cylinder head 19 within the second half of the sixth stroke.

The exhaust valves E and F remain open in the fifth stroke. Said exhaust valves close in the middle or at the end of the sixth stroke. In order to achieve best result, said exhaust valves can be closed in the middle of the sixth stroke at lower RPMs and at the end of the sixth stroke at higher RPMs by utilizing a conventional variable valve timing system.

The area of the exhaust valves E and F must be designed proportionately to cover the exhaust gases expelled from the cylinder 1 via the intake-exhaust valves A, B, C and D completely and efficiently. It is to be noted that the time required for the exhaust valves E and F to return to their seated position is at least four times as much as the time required for the intake-exhaust valves A, B, C, and D. This is because the exhaust valves start to close in the middle of the exhaust stroke and are completely closed in the middle of the sixth stroke. This is important while designing suitable and efficient valve springs for the valves E and F to further improve the engine efficiency.

In order to prevent the fuel-air mixture from wasting in a gasoline engine with a carburetor when the exhaust valves E and F are open, two of the four valves in the combustion chamber A, B, C, and D can be considered as intake valves and the rest of said valves can be considered as intake-exhaust valves. In this case, only the inlet ports of the intake valves are connected to the carburetor. Therefore, in the combustion chamber, four valves are open in an intake stroke, but only two valves are open in an exhaust stroke.

Figure 13:
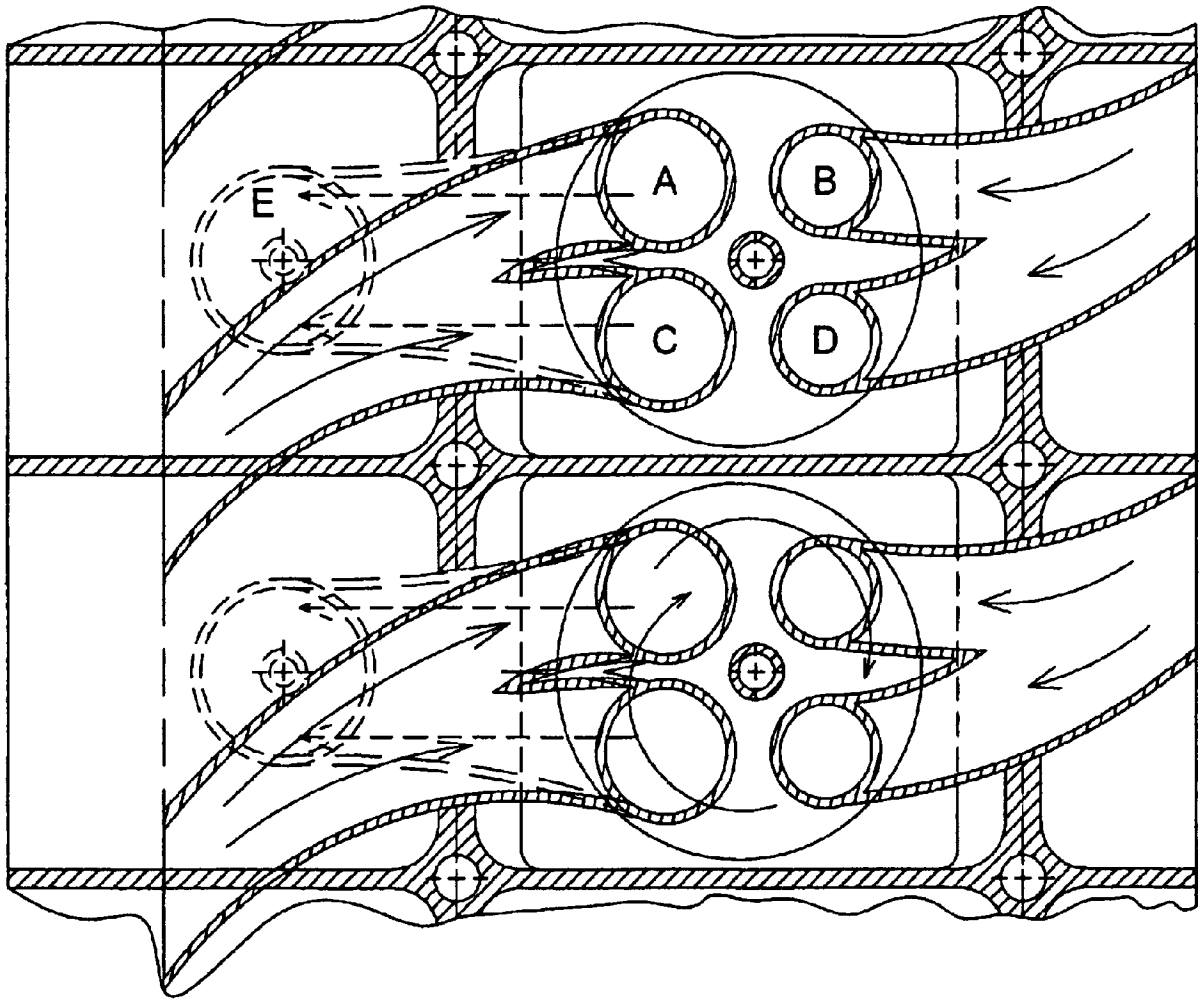
FIG. 13 shows a cylinder head with two intake valves B and D and two intake-exhaust valves A and C in the combustion chamber and one exhaust valve E in the side of the cylinder head, outside the combustion chamber.

FIG. 13 shows a cylinder head with five valves per cylinder, four of which are mounted in the cylinder head above the combustion chamber. The valves A and C are intake-exhaust valves, but the valves B and D are just intake valves. There is only one exhaust valve E in the side of the cylinder head, outside the combustion chamber. The valves B and D open in the middle of the fifth stroke and close at the beginning of the sixth stroke.

Referring to FIG. 13, the inlet ports of the intake-exhaust valves A and C and the inlet ports of the intake valves B and D are designed in a manner so as to provide a good swirling of the intake charge in the cylinder during the charging phase suitable for diesel engines.

The description of the invention is merely exemplary in nature and, thus, variations that do not depart from the gist of the invention are intended to be within the scope of the invention. Such variations are not to be regarded as a departure from the spirit and scope of the invention.

I claim:

1. A six-stroke internal combustion engine with reciprocating piston, comprising:

(a) at least one intake-exhaust valve; said intake-exhaust valve is located at the top of the combustion chamber;

said intake-exhaust valve functions as an intake valve in an intake stroke; said intake-exhaust valve functions as an exhaust valve in an exhaust stroke;

(b) said intake-exhaust valve opens at the beginning of an intake stroke and closes at the end of the intake stroke; then (c) said intake-exhaust valve remains closed in the compression stroke and the combustion stroke; and then (d) said intake-exhaust valve opens at the beginning of an exhaust stroke and closes at the end of the exhaust stroke; and then (e) said intake-exhaust valve opens in the middle of the fifth stroke while a piston is moving downward; and then (f) said intake-exhaust valve closes at the beginning or in the middle of the sixth stroke while the piston is moving upward.

2. The engine as claimed in claim 1 wherein:

(a) at least one exhaust valve is mounted in the side of a cylinder head, outside the combustion chamber in an outlet port;

(b) said exhaust valve is closed in an intake stroke, the compression stroke, and the combustion stroke.

(c) said exhaust valve is open in the exhaust stroke, the fifth stroke and the first half of the sixth stroke; said exhaust valve can also be closed at the end of the sixth stroke.

3. The engine as claimed in claim 1 wherein:

(a) there is a cam in the camshaft for each of the intake-exhaust valves;

(b) said cam has a first cam lobe to open the intake-exhaust valve in an intake stroke; and (c) said cam has a second cam lobe to open said valve in an exhaust stroke; and (d) said cam has a third cam lobe to open said valve in the middle of the fifth stroke and to close said valve at the beginning or in the middle of the sixth stroke.

4. The engine as claimed in claim 1 wherein:

(a) there is a cam in the camshaft for each of the exhaust valves;

(b) said cam has a cam lobe to open the exhaust valve at the beginning of an exhaust stroke and to close said valve in the middle, or at the end of the sixth stroke.

5. The engine as claimed in claim 1 wherein, one inlet port and one outlet port are connected to each other in the cylinder head close to the backside of each of the intake-exhaust valves.

6. The engine as claimed in claim 1 wherein:

(a) four valves are located at the top of the combustion chamber for each cylinder;

(b) two of said valves are intake-exhaust valves;

(c) the other two valves are just intake valves;

(d) said intake-exhaust valves and said intake valves open at beginning of an intake stroke and close at the end of the intake stroke; then (e) said intake-exhaust valves and said intake valves remain closed in the compression and combustion strokes; and then (f) said intake-exhaust valves open at beginning of an exhaust stroke and close at the end of the exhaust stroke; and (g) said intake-exhaust valves remain closed in the fifth and sixth strokes;

(h) said intake valves open in the middle of the fifth stroke and close at the beginning of the sixth stroke.

7. The engine as claimed in claim 6 wherein;

(a) at least one exhaust valve is mounted in the side of the cylinder head, outside the combustion chamber;

(b) said exhaust valve opens at the beginning of an exhaust stroke and closes in the middle or at the end of the sixth stroke.

8. The engine as claimed in claim 1, comprising:

(a) a crankshaft for a four-cylinder engine, (b) crankpins connected to pistons of two cylinders, having subsequent firing order, are 270 degrees apart on said crankshaft.

(c) the formula for other multi-cylinder engines is: 1080 divided by the number of cylinders.

* * * * *